United States Patent [19]

Ruter

[11] 3,990,489

[45] Nov. 9, 1976

[54] OIL FILLER CAP

[76] Inventor: Lewis L. Ruter, 2219 Third St. North, Minneapolis, Minn. 55411

[22] Filed: Aug. 19, 1974

[21] Appl. No.: 498,620

[52] U.S. Cl. ..... 141/98; 141/330; 141/386; 184/105 R

[51] Int. Cl.[2] ..... B65B 3/06; F01M 11/04

[58] Field of Search ..... 141/329, 330, 363, 364, 141/383, 384, 386, 98; 184/105 R; 222/81, 83.5, 86, 88; 215/332; 220/303, 86 R

[56] References Cited

UNITED STATES PATENTS

| | | | |
|---|---|---|---|
| 2,130,085 | 9/1938 | Harks | 184/105 R |
| 2,134,004 | 10/1938 | Pittman | 184/105 R |
| 2,467,088 | 4/1949 | Konchan | 220/303 X |
| 2,644,430 | 7/1953 | Lang | 222/83.5 X |
| 3,115,908 | 12/1963 | Carlson et al. | 141/330 |
| 3,331,405 | 7/1967 | Gaudet | 141/330 |
| 3,774,722 | 11/1973 | Elder | 141/330 X |

*Primary Examiner*—Richard E. Aegerter
*Assistant Examiner*—Frederick R. Schmidt
*Attorney, Agent, or Firm*—Burd, Braddock & Bartz

[57] ABSTRACT

An oil filler cap having a funnel-shaped body with a tubular neck adapted to be attached to the oil cap receiving structure of an internal combustion engine. A cover releasably mounted on top of the body carries a PVC valve connectable with a hose to the air intake manifold of the engine. A plurality of upwardly directed cutting blades attached to the bottom of the body are used to cut holes in the bottom of an oil can whereby oil can drain from the oil can into the engine.

7 Claims, 11 Drawing Figures

OIL FILLER CAP

BACKGROUND OF INVENTION

Internal combustion engines have oil caps that are used to close an oil fill opening into the top of the engine. Many vehicle owners add oil to and change the oil of their vehicles. Special tubular fill spouts are used to carry oil from cans, as quart cans, into the engine. In some cases separate funnels are used to carry the oil from the oil can to the engine. This requires a separate structure which must be stored, located to be used, and cleaned before use.

Harks shows in U.S. Pat. No. 2,130,065 a housing for accommodating an oil can. The housing has a knife to puncture the bottom of the can. A lid is used to close the top of the housing. Similar structures are known by Wiswell in U.S. Pat. Nos. 2,114,459, and 2,130,634.

It is desirable for pollution control that the blow by gases in the crank case of an internal combustion engine be carried back to the air inlet system of the engine. A PVC valve is used in conjunction with a hose to connect the crank case with the air inlet system. The PVC valve is periodically replaced when it becomes inefficient or inoperative.

SUMMARY OF INVENTION

The invention is directed to a structure adapted to be connected to a receiver, as a valve cover of an internal combustion engine in lieu of the conventional oil fill cap. The structure is an oil filler cap comprising a housing having a bottom wall carrying a structure which coacts with the valve cover to mount the oil filler cap on the valve cover. A cover closes the top on the housing. A plurality of upwardly directed blades are mounted on the bottom wall. The blades have cutting edges operable to cut holes in a container, as an oil can, so that the contents of the container can flow into the housing. A tubular neck secured to the bottom wall carries the material for the housing to the engine. A PVC valve mounted on the cover operates to connect the crank case of the engine to the air inlet system of the engine. The PVC valve can be replaced.

An object of the invention is to provide an oil filler cap that is useable as a funnel so that oil can be conveniently poured into an internal combustion engine. A further object of the invention is to provide an oil filler cap with structure useable to puncture a conventional oil can so that the oil from the can can flow into the internal combustion engine. Another object of the invention is to provide a combined funnel and cap adapted to be mounted on a fluid receiver. Yet another object of the invention is to provide an oil filler cap for an internal combustion engine which minimizes the escape of pollutant gases to the atmosphere. Another object of the invention is to provide an oil filler cap with a replaceable PVC valve. A further object of the invention is to provide an oil filler cap that can be mounted directly on a valve cover of an internal combustion engine. Another object of the invention is to provide a relatively low cost oil filter cap that is sturdy in construction and can be easily mounted on the oil cover of most conventional internal combustion engines without the use of tools and in a minimum of time.

IN THE DRAWINGS

DESCRIPTION OF PREFERRED EMBODIMENTS

Figure 1:
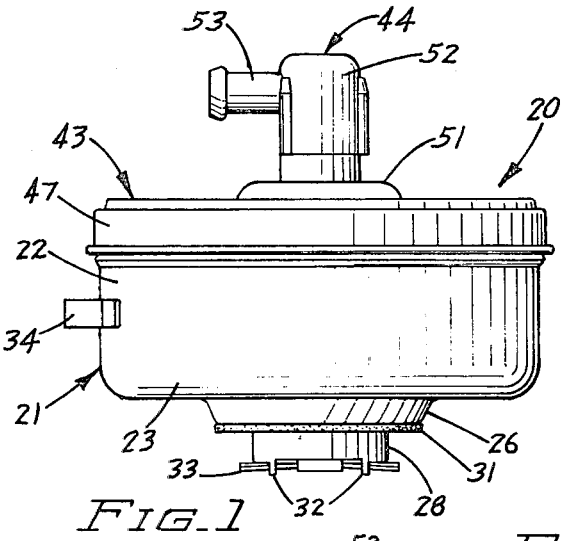
FIG. 1 is a side elevational view of a first embodiment of the oil filler cap of the invention.

First Embodiment — FIGS. 1 to 6

Referring to FIGS. 1 to 6 there is shown an oil filler cap indicated generally at 20. Cap 20 is adapted to be mounted on a valve cover of an internal combustion engine in lieu of the conventional oil cap. Oil filler cap 20 has a cylindrical body or housing 21 comprising a cylindrical sidewall 22 and a flat bottom wall 23. Sidewall 22 and bottom wall 23 surround a chamber 24 shown in FIG. 6. The central portion of bottom wall 23 has a downwardly projected tubular neck 26. Neck 26 has a flat circumferential annular shoulder 27 joined to a downwardly directed tubular extension 28. Neck 26 has a passage 29 open to the chamber 24 for directing the oil into an internal combustion engine. An annular gasket or washer 31 of resilient material surrounds the extension 28 and rests on the annular shoulder 27. Gasket 31 made of resilient material, as rubber or plastic, functions to seal the neck to the top of the valve cover.

Figure 5:
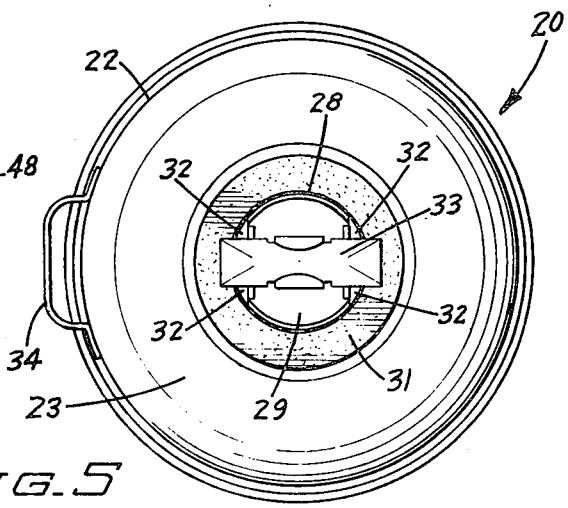
FIG. 5 is a bottom plan view of FIG. 1.
Figure 4:
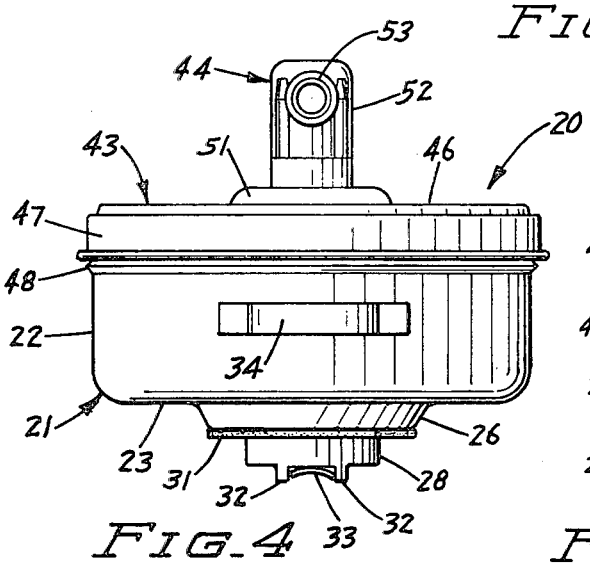
FIG. 4 is a side elevational view of the left side of FIG. 1.

A number of downwardly directed legs 32 extend from the bottom of extension 28. As shown in FIG. 5 legs 32 are in pairs on opposite sides of the extension 28. The legs embrace a transverse bar 33. The bar 33 has end portions which extend outwardly in opposite directions from the extension 28. The ends of the bar 33 cooperate with the valve cover (not shown) to releasably attach the oil filler cap 20 to the valve cover. The valve cover has inclined portions which ride on the ends of the bar 33 so that when the body 21 is rotated the bar and shoulder 27 will be clamped onto the valve cover. Sidewall 22 carries an outwardly directed handle 34 which facilitates the rotation of the housing 21.

Figure 2:
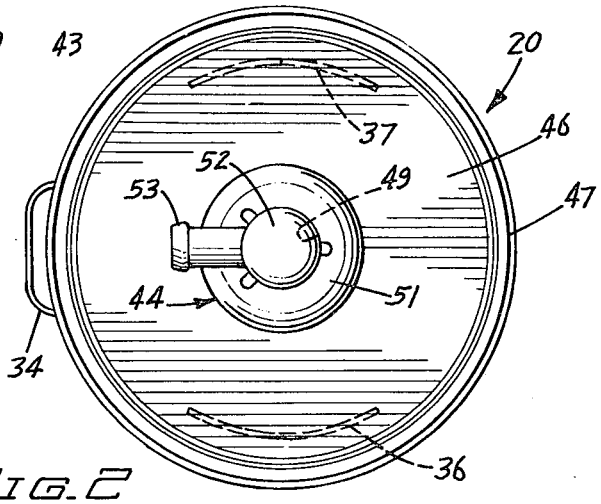
FIG. 2 is a top plan view of FIG. 1.
Figure 3:
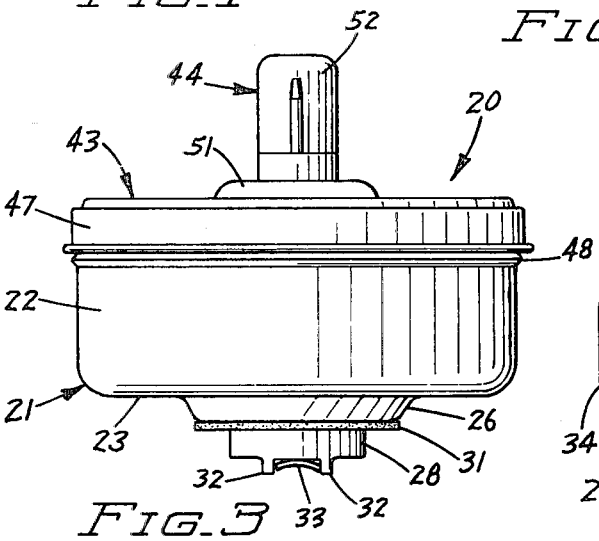
FIG. 3 is a side elevational view of the right side of FIG. 1.
Figure 6:
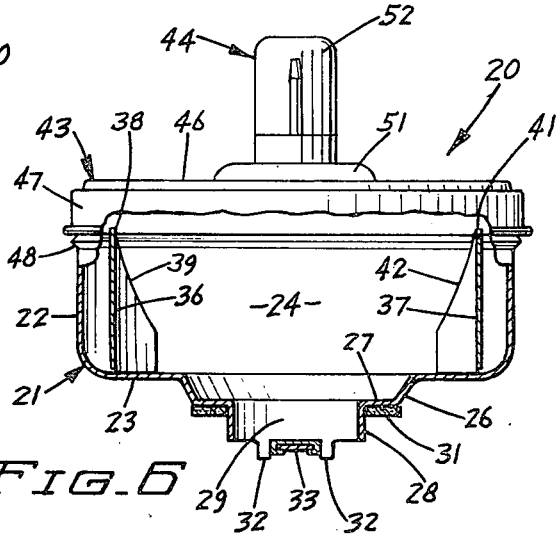
FIG. 6 is an elevational view similar to FIG. 3 partly sectional.

Referring to FIG. 6, a pair of upright blades 36 and 37 are attached to opposite portions of the bottom wall 23. Blade 36 has an upper point 38 and downwardly directed cutting edges 39. The blade 37 has an upper point 41 and downwardly directed cutting edges 42. As shown in FIG. 2, blades 36 and 37 have generally U-shaped configurations. The lower portions of the blades 36 and 37 are secured to the bottom wall 23. They can be welded, riveted, bolted, or secured in a similar fashion to the bottom wall 23. Additional blades can be mounted on the bottom wall 23. For example, a third blade can be attached to the bottom wall midway between the blades 36 and 37.

A cover indicated generally on 43 closes the top of housing 21. Cover 43 carries a PVC valve indicated generally at 44. The PVC valve 44 is a conventional pressure vacuum control valve connectable to a hose or suitable line leading to the air intake system or intake manifold of an internal combustion engine. Cover 23 has the generally flat top 46 and a downwardly directed annular flange 47. Flange 47 fits on or telescopes over the upper portion of the side wall. The side wall 22 has an outwardly directed circular rib 48 which serves as a circumferential stop for the flange 47. The flange 47 has a relatively tight fit on the side wall 22 to prevent the escape of blow by gases to the atmosphere. The cover 43 is readily removed from the housing 21 so that the housing 21 can be used as a funnel for directing oil into the engine.

The center portion of the top wall 43 of the cover has a hole for accommodating the base 51 of the PVC valve 44. Valve 44 has an upwardly directed body 52 and a laterally projected nipple 53. Base 51 has an annular groove (not shown) which accommodates the top wall 46 in the manner so that the PVC valve can be readily removed from the top wall and replaced in the event of its malfunction.

In use, the neck 26 is attached to the oil cover by placing the projection 28 through the hole in the cover. Rotation of the housing 21 will mount the neck 26 in the sealing relation with the valve cover. The cover 43 can be removed from the housing 21 by a slight twisting and upward motion. This opens the top of the housing so that an oil can, such as a quart can, can be moved downwardly into the chamber 24. The blades 36 and 37 will puncture the bottom wall of the oil can so that the oil in the can will drain through the passage 29 into the engine. The side wall 22 has a diameter slightly larger than the diameter of a conventional quart oil can so that the oil can can fit into the chamber. The blades 36 and 37 are spaced inwardly from the side wall 22 so that they can readily puncture the bottom wall of the oil can. The blades 36 and 37 being located within the chamber 27 can not be used to puncture the oil can before it is placed in the housing 22. This prevents spilling of the oil. The housing 22 being slightly larger than the diameter of the quart oil can will hold the quart oil can in a generally upright position during the draining of the oil from the cam into the engine. The user does not have to hold the oil can.

The oil can can be readily removed from the housing 21 by an upward force. This removes the can from the blades 36 and 37. The cover 43 is then replaced on the upper portion of housing 22. The engine is now ready to be used. In the event that the PVC valve needs to be replaced it can be readily removed from the cover 43 and replaced. The hose is removed from the nipple 53. A new PVC valve is mounted on the cover. The hose is then replaced on the nipple 53.

Figure 7:
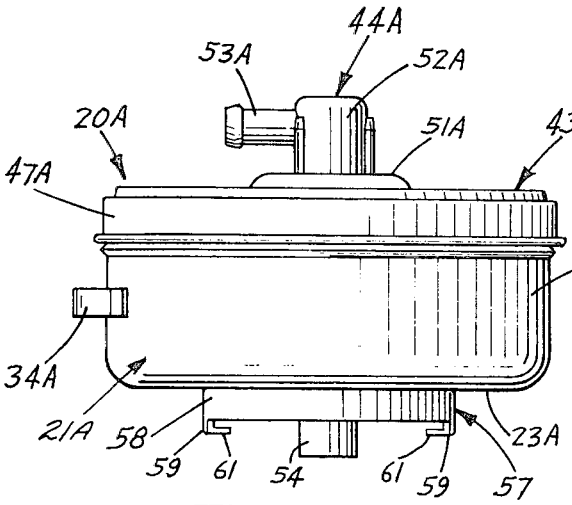
FIG. 7 is a side elevational view of a second embodiment of the invention.
Figure 8:
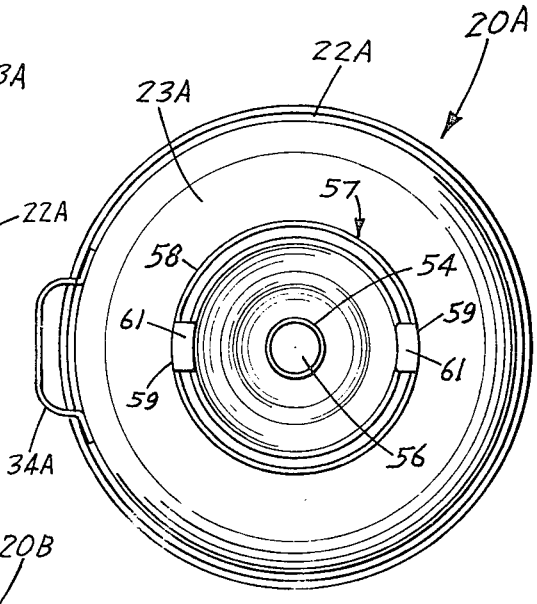
FIG. 8 is a bottom view of FIG. 7.

Second Embodiment — FIGS. 7 and 8

Referring to FIGS. 7 and 8, there is shown an oil filler cap indicated generally at 20A. The cap 20A has a body and cover structure identical with the oil filter cap 20 shown in FIGS. 1 through 6. The like parts of cap 20A that correspond to the same parts of cap 20 are identified with the same reference number having the suffix A. The body 21A has a downwardly directed neck 54 having a passage 56 open to the chamber of the body 21A. An inverted generally cup-shaped member 57 is mounted on the neck 54 and bottom wall 23A by welds, rivets, and the like. Member 57 has a downwardly directed circumferential flange 58. A plurality of downwardly directed legs 59 are integral with circumferentially spaced portions of the flange. The legs 59 have inwardly directed projections 61. The projections 61 are adapted to cooperate with grooves or external members on the valve cover of an internal combustion engine to mount the oil filler cap to the cover. The flange 58, legs 59, and projection 61, are structures used in lieu of the bar 33 of FIGS. 1 through 6 to mount the oil filter cap 21A on a valve cover having a structure that is compatible to cooperate with the projections 61.

Figure 9:
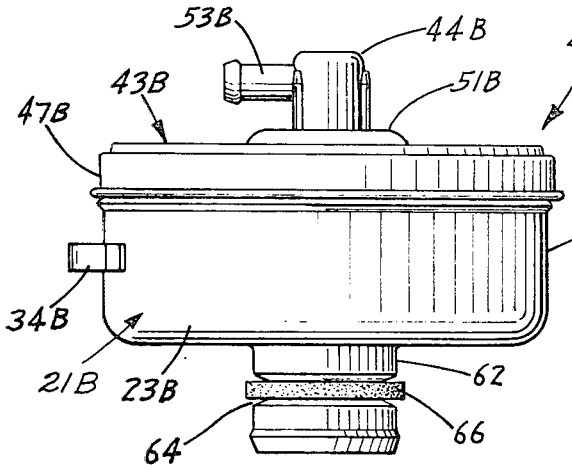
FIG. 9 is a side elevational view of a third embodiment of the invention.
Figure 10:
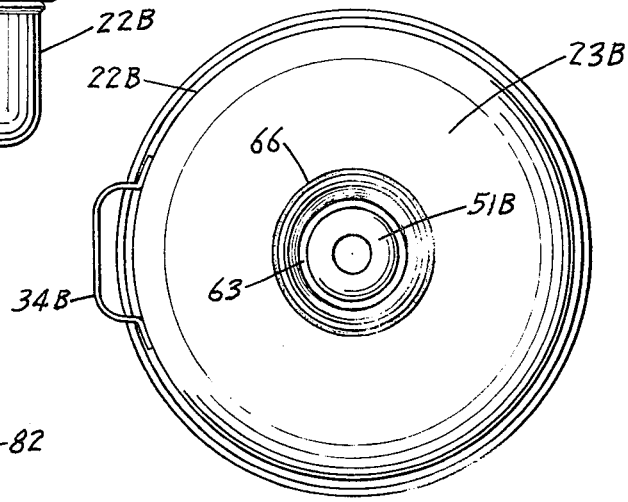
FIG. 10 is a bottom view of FIG. 9.

Third Embodiment — FIGS. 9 and 10

Referring to FIGS. 9 and 10, there is shown an oil filter cap indicated generally at 20B. Cap 20B has a body 21B, cover 43B, and PVC valve 44B, identical with the cover cap and PVC valve of the oil filter cap 20 shown in FIGS. 1 through 6. The parts of cap 20B that correspond to the same parts as cap 20 have the same reference numerals with the suffix B.

Oil filter cap 20B has a downwardly projected tubular neck 62 integral with the central portion with the bottom wall 23B. Neck 62 has a passage 63 open to the interior of the housing 22B. The midportion of the neck 62 has an inwardly directed annular groove 64 accommodating a washer or seal member 66. The neck 62 is adapted to be located in the tubular portion of an oil filling passage. Washer 66 seals and frictionally holds the oil filter cap 20B in assembled relation with the tube.

Figure 11:
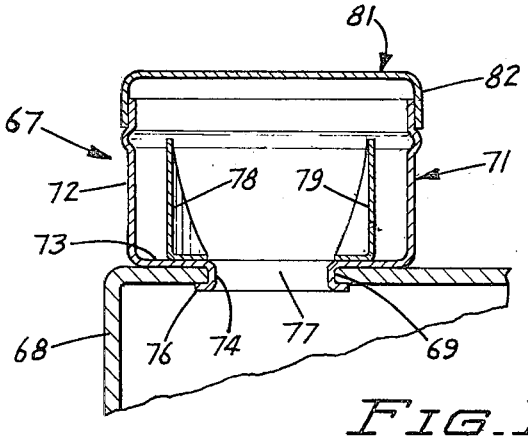
FIG. 11 is a sectional view of a fourth embodiment of the invention.

Fourth Embodiment — FIG. 11

Referring to FIG. 11, there is shown an oil filter cap of the invention indicated generally at 67. Cap 67 is mounted in assembled relation with a valve cover 68. Valve cover 68 has a hole 69 providing access to the inside of cover 68. Cap 67 has a housing indicated generally at 71 of a size to accommodate the end of a quart container whereby oil can be supplied to the engine. Housing 71 has a circular side cylindrical side wall 72 adjoined to a bottom wall 73. The center portion of bottom wall 73 has a downwardly extended tubular neck 74. The lower end of neck 74 has an outwardly directed flange 76 crimped about the portion of the valve cover 67 forming the hole 69 thereby securing the housing 71 to the valve cover 67. Neck 76 has a passage 77 open to the inside of valve cover 68 and the chamber defined by the side wall 72.

A pair of upwardly directed blades 78 and 79 are attached to the bottom wall 73. Blades 78 and 79 are cutting members operable to pierce the bottom of a container, such as a quart oil can to thereby allow the oil in the can to drain from the can into the engine via the passage 77.

The top of the housing 71 is closed with a cover 81. Cover 81 has downwardly directed circular flange 82 releasably mounted on the upper portion of side wall 72. Cover 81 can carry a PVC valve as shown in FIGS. 1 through 6.

The oil filter caps herein described can be made of metal, plastic, or other suitable rigid materials. The housing can be made by stamping, rolling, molding, or other manufacturing processes. The covers can carry PVC valves. Alternatively, the covers can be constructed according to the cover 81 as shown in FIG. 11.

The filler caps have been described as useable on valve covers to provide can opening structure, funnel structure and closure structure. The caps can be used with other parts of an internal combustion engine used to carry oil to the engine. The engines can be in automobiles, trucks, buses, tractors, boats and the like. The filler cap of the invention can be made of metal, plastic or like structural materials. Also, the filler cap can be used with other types of fluid receivers, as a combined funnel and closure.

While there have been shown and described preferred embodiments of the invention it is understood that changes in the size, materials, can be made by those skilled in the art without departing from the invention. The invention is defined in the following claims.

The embodiments of the invention in which an exclusive property or privilege is claimed are defined as follows:

1. A fluid filler cap adapted to be releasably mounted on a fluid receiver comprising: housing means having a rigid side wall terminating in a circular top edge surrounding an open top, and a rigid bottom wall defining a chamber, said rigid side wall having outwardly directed rib means located below the top edge and a cylindrical section located between the rib means and top edge, said chamber being of a size to accommodate a portion of a quart oil can, a linear tubular neck means secured to the bottom wall and projected downwardly therefrom, said neck means including a passage open to the bottom of the chamber and open below the bottom wall whereby fluid can flow from the chamber through the neck means into a fluid receiver on which the cap is mounted, means associated with the neck means including laterally directed projection means mounted on the neck means for releasably attaching the neck means on a fluid receiver having means to accommodate the neck means and means to cooperate with the projection means to hold the neck means on the fluid receiver, said neck means being rotatable to rotate the projection means to a position to mount the neck means and bottom wall on the fluid receiver, seal means surrounding the neck means and engageable with a part of the neck means and fluid receiver to seal the connection between the neck means and the fluid receiver when the neck means is attached to the fluid receiver, and cover means mounted on the side wall to close the top of the housing means, said cover means having an annular flange located in engagement with said cylindrical section to prevent the escape of gases from the chamber to the atmosphere.

2. The cap of claim 1 including: blade means mounted on the bottom wall and extended into the chamber, said blade means useable to puncture a container whereby fluid in the container flows into the chamber.

3. The cap of claim 1 including: PVC valve means mounted on the cover means, said valve means adapted to be connected to a vacuum line whereby gases in said chamber are drawn through the valve means into the vacuum line.

4. The cap of claim 1 wherein: the projection means includes a transverse bar and means to connect the bar to the neck means.

5. The cap of claim 1 wherein: the projection means includes leg means having inwardly directed projections.

6. The cap of claim 1 wherein: the means associated with the neck means includes an annular flange attached to the bottom wall, leg means joined to the flange, and said projection means includes inwardly directed projections on the leg means.

7. The cap of claim 1 wherein: the neck means has an annular shoulder, and said seal means includes resilient washer means located around the neck means engageable with the shoulder.

* * * * *